US011723444B2

(12) United States Patent
Silvant

(10) Patent No.: US 11,723,444 B2
(45) Date of Patent: Aug. 15, 2023

(54) DEVICE FOR ATTACHING A BRACELET

(71) Applicant: Omega S.A., Biel/Bienne (CH)

(72) Inventor: Olivier Silvant, Macolin (CH)

(73) Assignee: OMEGA SA, Biel/Bienne (CH)

( * ) Notice: Subject to any disclaimer, the term of this patent is extended or adjusted under 35 U.S.C. 154(b) by 0 days.

(21) Appl. No.: 17/532,593

(22) Filed: Nov. 22, 2021

(65) Prior Publication Data

US 2022/0202146 A1 Jun. 30, 2022

(30) Foreign Application Priority Data

Dec. 30, 2020 (EP) ..... 20217855

(51) Int. Cl.
*A44C 5/14* (2006.01)

(52) U.S. Cl.
CPC ..... *A44C 5/14* (2013.01)

(58) Field of Classification Search
CPC ..... A44C 5/14; G04B 37/1486
See application file for complete search history.

(56) References Cited

U.S. PATENT DOCUMENTS 3,581,960 A * 6/1971 Ojima ..... A44C 5/145 24/265 WS
4,217,681 A * 8/1980 Grohoski ..... G04B 37/1486 224/164
4,564,308 A * 1/1986 Ikegami ..... A44C 5/14 968/360
6,098,394 A * 8/2000 Hashimoto ..... G04B 37/1486 59/80
6,647,593 B2 * 11/2003 Iguchi ..... A44C 5/14 74/56
7,300,201 B2 * 11/2007 Man ..... G04B 37/1486 368/282

(Continued)

FOREIGN PATENT DOCUMENTS

CH 327838 A 2/1958
CH 614589 A3 12/1979

(Continued)

OTHER PUBLICATIONS

European Search Report for EP 20 21 7855 dated Jun. 8, 2021.
Office Action dated Jan. 10, 2023 from the Japanese Patent Office in JP Application No. 2021-199814.

*Primary Examiner* — Robert Sandy
*Assistant Examiner* — Louis A Mercado
(74) *Attorney, Agent, or Firm* — Sughrue Mion, PLLC

(57) ABSTRACT

A device for attaching a bracelet or strap to a watch case, the device including, on the one hand, a bar secured to the watch case by a horn, and on the other hand, an insert integral with the end of the bracelet, wherein the bar and the insert are complementary to interlock with each other forming a removable assembly to make the bracelet interchangeable. The insert includes a movable pivot mounted in the insert and arranged to engage in a corresponding hole of the horn, the device having handling device integral with the movable pivot in order to move from a first position, in which the pivot is free to move and the strand can be assembled and/or disassembled, to a second position, in which said pivot is stationary in translation and the bracelet strand is locked on the watch case.

14 Claims, 3 Drawing Sheets

(56) References Cited

U.S. PATENT DOCUMENTS

| | | | | |
|---|---|---|---|---|
| 9,009,926 | B2 * | 4/2015 | Ehrsam | G04B 37/1486 24/700 |
| 10,667,584 | B2 * | 6/2020 | Liao | G04B 37/1493 |
| 10,993,512 | B2 * | 5/2021 | Rochat | G04B 37/1493 |
| 11,460,812 | B2 * | 10/2022 | Taniguchi | G04B 37/1486 |
| 2005/0272486 | A1 * | 12/2005 | Kim | G04G 17/02 455/575.1 |
| 2020/0315304 | A1 * | 10/2020 | Humbert | A44C 5/145 |
| 2022/0283548 | A1 * | 9/2022 | Meleddu | A44C 5/14 |

FOREIGN PATENT DOCUMENTS

| | | | |
|---|---|---|---|
| EP | 1 400 875 | A1 | 3/2004 |
| EP | 3 473 127 | A1 | 4/2019 |
| FR | 2 686 713 | A1 | 7/1993 |
| JP | 62-136811 | U | 8/1987 |

* cited by examiner

DEVICE FOR ATTACHING A BRACELET

CROSS REFERENCE TO RELATED APPLICATION

This application is Non-Provisional Application, claiming priority on European Patent Application 20217855.4 filed Dec. 30, 2020.

FIELD OF THE INVENTION

The present invention relates to the field of horology or jewelry. More specifically, it concerns a method for attaching a strap or bracelet to an object, particularly a watch case.

BACKGROUND OF THE INVENTION

Generally, straps or bracelets, made of leather or metal, are attached to the horns of a watch case by means of a bar formed of a tube, inside which are mounted two pistons that move in translation, and an elastic member disposed between said pistons and intended to drive them outwardly of the tube. Said bar is mounted inside a housing provided for this purpose at one end of the bracelet, and the pistons are engaged in blind bores made facing each other in the horns of the case.

To detach a strap or bracelet attached to a case in this manner, it is necessary to have a tool designed to push the pistons back into the tube, against the stress exerted by the elastic member, and thereby remove them from the bores. The wearer of the watch does not permanently carry such a tool, and furthermore, the tool can be inconvenient to use. This is why bracelets provided with such an attachment device are generally permanently secured to the case.

There are also attachment devices that allow the bracelet to be detached from the case without using a tool. Such devices usually comprise a bar, of the type described above, on which is mounted, through the tube, a member for actuating the pistons. Said actuation member is, for example, a radial finger integral with one of the pistons, as described in Swiss Patent No CH327838. The finger is slidably mounted through an axial slot made in the tube, and its movement along the slot pushes one of the pistons back inside the tube.

Swiss Patent No. CH614589 discloses a watch case with a device for attaching a strap to the case, the central horn has a cylindrical passage slit longitudinally over the entire length of the horn, to allow the insertion of a bar for attaching a strap. The bar takes the form of a cylinder with a flat portion over its entire length to allow the bar to pass when inserted into the passage and to hold the bar in place when the latter occupies a determined angular position.

The attachment devices thus described are generally employed for interchangeable bracelets or straps which the user can then change as desired. However, they are not without drawbacks. It will be noted, in particular, that they require major structural modifications to the bar, such as, for example, making an opening in the tube, or transforming the pistons. These changes entail significant extra manufacturing costs. These attachment devices also include a protruding element, namely the actuating member, which may snag or injure the wearer of the watch.

SUMMARY OF THE INVENTION

The present invention makes it possible to overcome these drawbacks, by proposing a device for attaching a bracelet or strap to a watch case, the device comprising said watch case and said bracelet, said bracelet being secured to the watch case by means of at least one central horn, and at least one insert integral with the end of a bracelet, the insert having a recess of complementary shape to the horn so as to interlock with each other forming removable assembly means capable of making the bracelet interchangeable.

According to the invention, the insert comprises at least one movable pivot mounted in the insert and partially projecting into the recess in the insert, the movable pivot being arranged to engage in a corresponding hole in the horn, and the device comprises handling means integral with the movable pivot in order to move from a first position, called the handling position, in which the pivot is free to move and the strand can be assembled and/or disassembled, to a second position, called the rest position, in which the pivot is stationary in translation and the bracelet strand is locked on the watch case.

According to other advantageous variants of the invention:

- said handling means are arranged to pivot and comprise a cylindrical body and a handling loop integral with the cylindrical body, said cylindrical body being housed in a passage of the insert and the loop resting against the edge of the insert;
- the cylindrical body is hollow and is arranged to receive the at least one movable pivot;
- the hollow cylindrical body comprises in succession a first housing with a first diameter D1, a second housing with a diameter D2, and a third housing with a diameter D3, diameters D2 and D3 being greater than diameter D2;
- the at least one movable pivot includes a shaft and a head, said shaft having a slightly smaller diameter than diameter D2 and passing successively through the third, second and first housings, and the head having a slightly smaller diameter than diameter D3 in order to rest in the third housing;
- the first housing is arranged to receive return means, such as a helical spring, said return means being mounted around the shaft and held in the first housing by means of a key mounted on the pivot shaft in order to hold the pivot head in the third housing;
- the key has smaller dimensions than diameter D1 of the first housing so that the return means can be compressed during a translation of the pivot;
- the insert comprises a pin arranged to cooperate with a peripheral groove formed on the outside of the cylindrical body in order to hold the handling means inside the insert;
- the cylindrical body comprises, in immediate proximity to the peripheral groove, a flat portion so that the cylindrical body can be moved in translation;
- the insert comprises at least one ball catch arranged to cooperate with the handling loop and lock the latter in the second position;
- the handling loop is parallel to the insert in the rest position, and is perpendicular to the insert in the handling position, the handling loop moving from one position to the other via a 90-degree rotation;
- the insert comprises a U-shaped recess.

BRIEF DESCRIPTION OF THE DRAWINGS

Other features and advantages of the present invention will appear more clearly from the following detailed description of an example embodiment of a bracelet attachment device according to the invention, this example being given solely by way of non-limiting illustration with reference to the annexed drawing, in which.

DETAILED DESCRIPTION OF PREFERRED EMBODIMENTS

Figure 1:
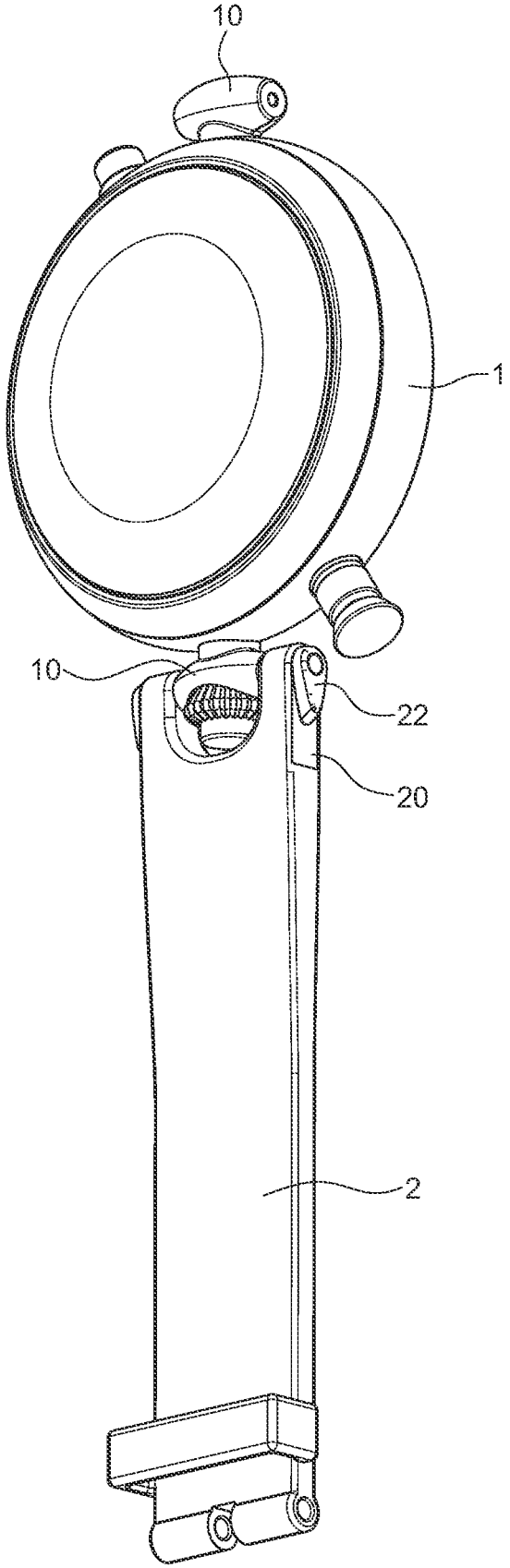
FIG. 1 illustrates a perspective view of a watch case equipped with an attachment device according to the invention.

FIG. 1 illustrates a wristwatch and detailed views of the device for attaching the bracelet to watch case 1 according to a preferred embodiment of the invention. The device for attaching bracelet strand 2 to watch case 1 comprises, on the one hand, a horn 10 secured to watch case 1 by means of at least one horn integral with the case, and on the other hand, an insert 20 integral with the end of bracelet strand 2, horn 10 and insert 10 being complementary so as to interlock or clip one inside the other forming removable assembly means capable of making bracelet 2 interchangeable.

Figure 2A:
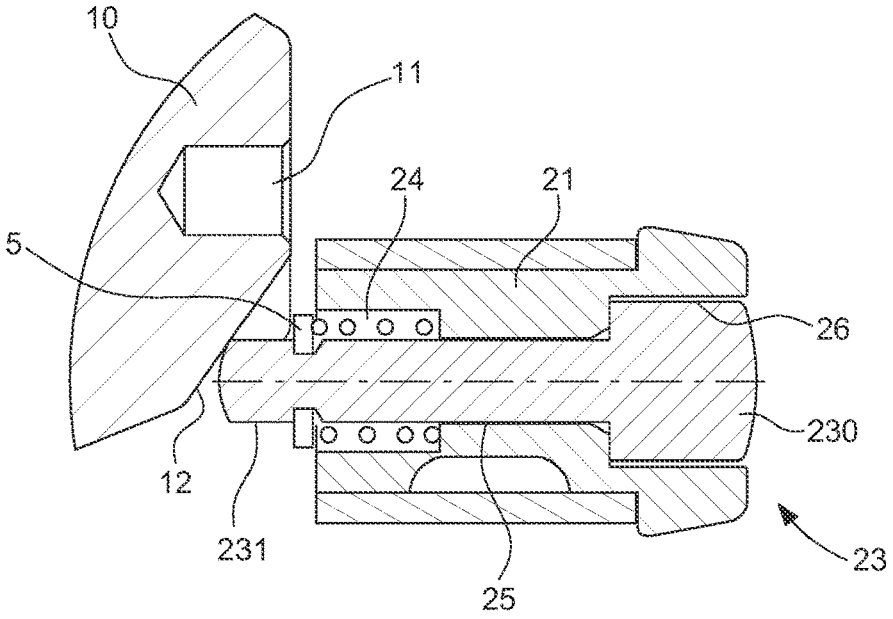
FIGS. 2*a* and 2*b* illustrate sectional views of an attachment device according to the invention fitted to a watch case before and after assembly.
Figure 2B:
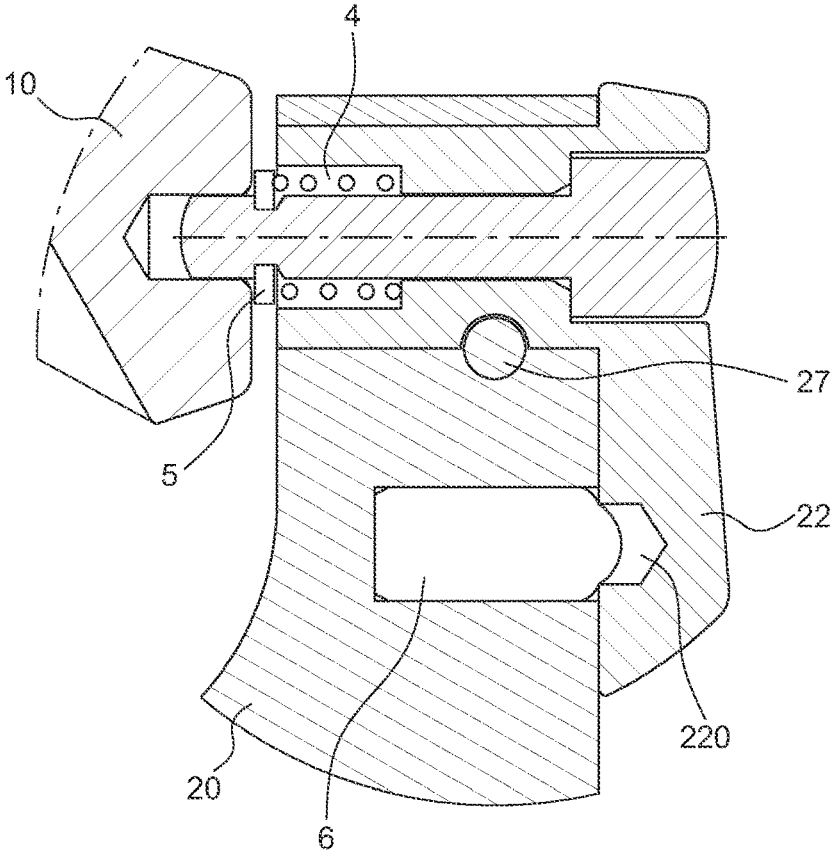
Figure 3A:
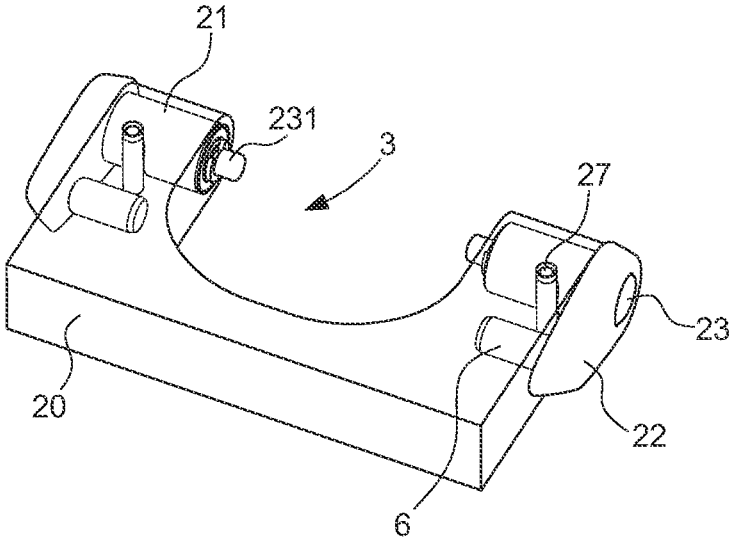
FIGS. 3*a* to 3*c* are transparent perspective views of an attachment device according to the invention.
Figure 3B:
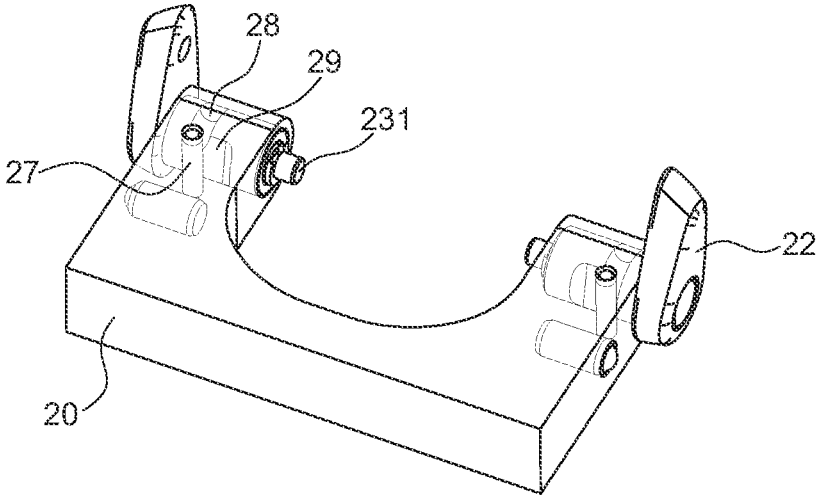
Figure 3C:
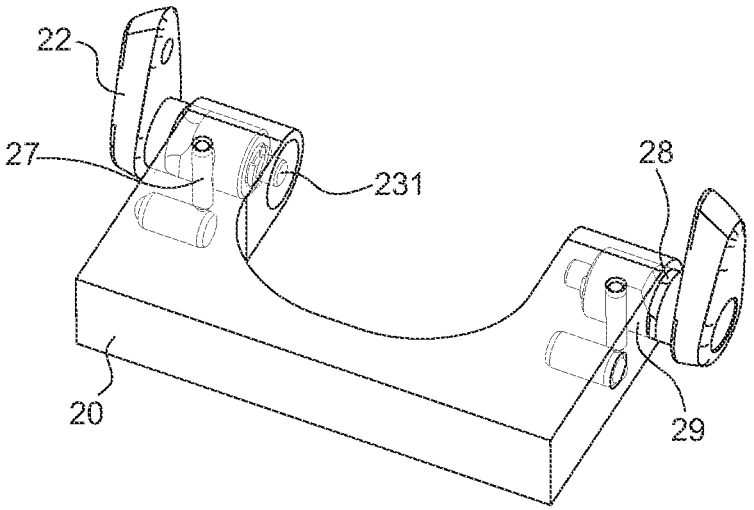

As illustrated in FIGS. 2*a* and 2*b*, insert 20 comprises at least one movable pivot 23 mounted in a passage formed in insert 20, the passage being close to the free end of the insert. Advantageously, pivot 23 partially projects into a recess 3 of the insert, movable pivot 23 being arranged to engage in a corresponding hole 11 in horn 10.

The device according to the invention comprises handling means integral with movable pivot 23 in order to move from a first position, called the handling position, in which said pivot 23 is free to move and strand 2 can be assembled and/or disassembled, to a second position, called the rest position, in which said pivot 23 is stationary in translation and the bracelet strand is locked on the watch case.

As can be observed in FIGS. 2*a* to 2*b*, watch case 1 includes a central horn 10 comprising a hole 11 on either side and whose diameter corresponds to the diameter of pivot 23 so that the latter can rotate freely inside the hole. To facilitate the insertion of the at least one pivot 23 into hole 11, the central horn includes a slope 12 guiding the pivot to hole 11.

According to the invention, insert 20 comprises at least one pivot, the pivot being constrained by return means 4, such as a helical spring. As illustrated in the Figures, insert 20 comprises two movable pivots arranged on either side so that each of the pivots emerges in recess 3 of insert 20. As illustrated, recess 3 is U-shaped, although of course the latter can adopt any other type of shape, such as a parallelepiped, hemispherical or even elliptical shape, in order to adapt to the shape of the watch case horn.

Insert 20 can also be made of metal or metal alloy, technical ceramics, composite material, or plastic material depending on the requirements of those skilled in the art.

According to the invention, the handling means are arranged to pivot from a rest position to a handling position and comprise a cylindrical body 21 and a handling loop 22 integral with cylindrical body 21, cylindrical body 21 being housed in a passage formed in insert 20 and loop 22 resting against the edge of insert 20 so that the means can be handled manually.

Handling loop 22 is parallel to insert 20 in the rest position and is perpendicular to insert 20 in the handling position, with handling loop 22 moving from one position to the other via a 90-degree rotation. This angle of rotation makes it easy to handle loop 22 with the fingers.

Advantageously, insert 20 comprises at least one ball catch 6 arranged to cooperate with an orifice 220 of handling loop 22 and to lock the latter in the rest position when the watch is worn, or the bracelet is not being used.

As can be observed in FIGS. 2*a* and 2*b*, cylindrical body 21 is hollow and is arranged to receive a movable pivot 23, pivot 23 being able to pivot freely in cylindrical body 21. Cylindrical body 21 comprises in succession a first bore 24 with a first diameter D1, a second bore 25 with a diameter D2, and a third bore 26 with a diameter D3, diameters D2 and D3 being greater than diameter D2. Thus, the three bores form a through hole with a reduction in diameter in the centre.

Movable pivot 23 comprises a shaft 231 and a head 230, shaft 231 having a slightly smaller diameter than diameter D2 and passing successively through the third, second and first bores 26, 25, 24. Head 230 has a slightly smaller diameter than diameter D3 in order to rest inside third bore 26 and against second bore 25 which acts as a stop for head 230. Thus, pivot 23 is inserted into the handling means through third bore 26 up to the stop. Advantageously, pivot head 230 is flush with the surface of loop 22, so as to make the device as discreet as possible.

According to the invention, first bore 24 is arranged to receive return means 4, return means 4 being mounted around shaft 231 and held in first bore 24 by means of a key 5. Key 5 is mounted on the pivot shaft so as to compress the return means and to hold pivot head 230 inside third bore 26.

Advantageously, key 5 has smaller dimensions than diameter D1 of first bore 24 so that it can enter first bore 24 when the pivot is compressed. During assembly, the pivot rests against slope 12 of horn 10, which has the effect of pressing on shaft 231 and compressing spring 4 until the shaft enters hole 11, the pivot then returning to its rest position under the return effect of spring 4. This type of assembly makes it possible, on the one hand, to hold the pivot in position when it is inserted into hole 11 by means of the return means, and on the other, to remove said pivot from hole 10 when required via the handling means by means of head 230 which is resting against second bore 25. Those skilled in the art could also envisage replacing the assembly consisting of the shaft and key with a screw screwed into head 230 of pivot 23.

The attachment device according to the invention also comprises means for holding and locking the handling means. These holding and locking means comprise a pin 27 mounted in the insert perpendicularly to the direction of the bracelet strand. This pin 27 is arranged to cooperate with a peripheral groove 28 formed on the outside of cylindrical body 21, close to the loop, in order to hold the handling means in the insert, pin 27 and groove 28 forming axial retention means.

Advantageously, cylindrical body 21 comprises, in immediate proximity to peripheral groove 28, a flat portion 29 so that the cylindrical body can be moved in translation when the flat portion and pin are aligned. Flat portion 29 is angularly positioned on the cylindrical body such that the flat portion and the pin are aligned following a rotation of the handling element to bring it into the handling position.

To attach bracelet 2 to case 1, as illustrated in FIG. 1, the wearer places insert 20 near central horn 10, while moving the projecting part of the pivots towards slopes 12 of horn 10. The wearer then moves the pivots against the slopes which function as guide means, and which has the effect of retracting the two pivots. The wearer continues the movement until the pivots are engaged in the two holes 11 of horn 10, the pivots returning to their rest position under the action of return means 4. A 'click' positions the bracelet when pivots 3 are engaged in holes 10, preventing the bracelet from falling, and facilitating the locking of the bracelet without exerting pressure thereon. Bracelet strand 2 is then locked on watch case 1 since pivots 23 can no longer be moved in translation out of holes 10 of the horn.

To disassemble the bracelet, the watch wearer pivots handling loop 22 from its rest position to its handling position by making a 90-degree rotation, this rotation has the effect of positioning flat portion 29 opposite pin 27. The wearer can then pull loop 22 to move the latter in translation and remove shaft 231 of pivot 23 from hole 11 of the horn, and then release the bracelet from the horn. Once the bracelet has been released from the horn, the wearer presses loop 22 back in until it is in contact with insert 20 and pivots the loop again in order to place it parallel to insert 20 and lock it in position via ball catch 6.

In the embodiment described above, the insert is connected to a bracelet strand 2 which may be made of leather, synthetic fabric, plastic, metal, ceramic or composite material.

As a result of these various aspects of the invention, there is provided a secure bracelet attachment device allowing the bracelet to be quickly and easily changed.

The invention claimed is:

1. An attachment device for attaching a bracelet strand to a watch case, the device comprising said watch case and said bracelet, said bracelet being secured to the watch case by a central horn of the watch case, and an insert integral with an end of a bracelet, the insert having a recess of complementary shape to the horn to cooperate by clipping together forming removable assembly means capable of making the bracelet strand interchangeable, wherein the insert comprises a movable pivot slidably mounted in a passage in the insert, said movable pivot being arranged to engage in a corresponding hole of the horn, and wherein the device comprises handling means integral with the movable pivot and movable from a first position, called a handling position, in which said movable pivot is free to slidably move in translation in a longitudinal direction thereof with respect to the insert and the strand can be assembled and/or disassembled, to a second position, called a rest position, in which said movable pivot is stationary in translation with respect to the insert and the bracelet strand is locked on the watch case.

2. The attachment device according to claim 1, wherein said handling means are arranged to pivot and comprise a cylindrical body and a handling loop integral with the cylindrical body, said cylindrical body being housed in the passage of the insert and the loop resting against an edge of the insert.

3. The attachment device according to claim 2, wherein said cylindrical body is hollow and is arranged to receive the movable pivot.

4. The attachment device according to claim 2, wherein the cylindrical body comprises in succession a first bore with a diameter D1, a second bore with a diameter D2, and a third bore with a diameter D3, diameters D1 and D3 being greater than diameter D2.

5. The attachment device according to claim 4, wherein the movable pivot includes a shaft and a head, said shaft having a slightly smaller diameter than diameter D2 and passing successively through the third, second and first bores, and the head having a slightly smaller diameter than the diameter D3 in order to rest in the third bore.

6. The attachment device according to claim 5, wherein the first bore is arranged to receive return means, said return means being mounted around the shaft and held in the first bore by means of a key mounted on the shaft in order to compress the return means and hold the head in the third bore.

7. The attachment device according to claim 6, wherein said key has smaller dimensions than diameter D1 of the first bore so that the return means can be compressed during a translation of the pivot.

8. The attachment device according to claim 2, wherein the insert comprises a pin arranged to cooperate with a peripheral groove formed on an outside of the cylindrical body in order to lock the handling means inside the insert.

9. The attachment device according to claim 8, wherein said cylindrical body comprises, in immediate proximity to the peripheral groove, a flat portion so that the cylindrical body can be moved in translation when the flat portion and the pin are aligned.

10. The attachment device according to claim 2, wherein the insert comprises a ball catch arranged to cooperate with the handling loop and to lock the latter in the rest position.

11. The attachment device according to claim 2, wherein the handling loop is parallel to the insert in the rest position and is perpendicular to the insert in the handling position, the handling loop moving from one position to the other via a 90-degree rotation.

12. The attachment device according to claim 1, wherein the insert comprises a U-shaped recess.

13. An attachment device for attaching a bracelet strand to a watch case, the device comprising said watch case and said bracelet, said bracelet being secured to the watch case by a central horn of the watch case, and an insert integral with an end of a bracelet, the insert having a recess of complementary shape to the horn to cooperate by clipping together forming removable assembly means capable of making the bracelet strand interchangeable, wherein the insert comprises a movable pivot mounted in the insert, said movable pivot being arranged to engage in a corresponding hole of the horn, wherein the device comprises handling means integral with the movable pivot and movable from a first position, called a handling position, in which said movable pivot is free to move and the strand can be assembled and/or disassembled, to a second position, called a rest position, in which said movable pivot is stationary in translation and the bracelet strand is locked on the watch case, wherein said handling means are arranged to pivot and comprise a cylindrical body and a handling loop integral with the cylindrical body, said cylindrical body being housed in a passage of the insert and the loop resting against an edge of the insert, and wherein said cylindrical body is hollow and is arranged to receive the movable pivot.

14. An attachment device for attaching a bracelet strand to a watch case, the device comprising said watch case and said bracelet, said bracelet being secured to the watch case by a central horn of the watch case, and an insert integral with an end of a bracelet, the insert having a recess of complementary shape to the horn to cooperate by clipping together forming removable assembly means capable of making the bracelet strand interchangeable, wherein the insert comprises a movable pivot mounted in the insert, said movable pivot being arranged to engage in a corresponding hole of the horn, wherein the device comprises handling means integral with the movable pivot and movable from a first position, called a handling position, in which said movable pivot is free to move and the strand can be assembled and/or disassembled, to a second position, called a rest position, in which said movable pivot is stationary in translation and the bracelet strand is locked on the watch case, wherein said handling means are arranged to pivot and comprise a cylindrical body and a handling loop integral with the cylindrical body, said cylindrical body being housed in a passage of the insert and the loop resting against an edge of the insert, and wherein the insert comprises a pin arranged to cooperate with a peripheral groove formed on an outside of the cylindrical body in order to lock the handling means inside the insert.

* * * * *